US007305958B2

(12) United States Patent
Doko et al.

(10) Patent No.: US 7,305,958 B2
(45) Date of Patent: Dec. 11, 2007

(54) INTAKE MANIFOLD

(75) Inventors: Yukihiro Doko, Obu (JP); Makoto Fujimori, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 57 days.

(21) Appl. No.: 11/339,703

(22) Filed: Jan. 26, 2006

(65) Prior Publication Data

US 2006/0191505 A1 Aug. 31, 2006

(30) Foreign Application Priority Data

Feb. 28, 2005 (JP) ..... 2005-054880

(51) Int. Cl.
*F02M 35/10* (2006.01)
*F02B 47/08* (2006.01)

(52) U.S. Cl. ..... 123/184.21; 123/184.61; 123/568.11

(58) Field of Classification Search ..... 123/572, 123/568.11, 184.21, 184.38, 184.42, 184.47, 123/184.61
See application file for complete search history.

(56) References Cited

U.S. PATENT DOCUMENTS 6,807,957 B2 * 10/2004 Ko ..... 123/572
2005/0039730 A1 * 2/2005 Nishida et al. ..... 123/568.17

FOREIGN PATENT DOCUMENTS

| | | |
|---|---|---|
| JP | A-06-108928 | 4/1994 |
| JP | A-2000-192862 | 7/2000 |
| JP | A 2002-322953 | 11/2002 |

* cited by examiner

*Primary Examiner*—Noah Kamen
(74) *Attorney, Agent, or Firm*—Oliff & Berridge, PLC

(57) ABSTRACT

An intake manifold including a collecting pipe and a plurality of branch pipes comprises a single gas intake port, a gas outlet port opening into each branch pipe, and a gas passage extending to be divided into more than one branch passages from the gas intake port to each gas outlet port. The gas passage is configured so that the branch passages are equal in pressure loss which will be generated between the gas inlet port and each gas outlet port, and the gas passage extends to be branched in stages from the gas inlet port to each gas outlet port, forming a tournament-form configuration which is symmetrical about the gas inlet port. The collecting pipe and each branch pipe are integrally molded of resin. The gas inlet port and the gas passage are provided in a projecting section integrally molded with the branch pipes.

10 Claims, 11 Drawing Sheets

INTAKE MANIFOLD

BACKGROUND OF THE INVENTION

1. Field of the Invention

The present invention relates to an intake manifold for distributing air into a plurality of cylinders of an engine and, more particularly, to an intake manifold having a gas passage for returning gas such as a blowby gas (a PCV gas) having leaked out of the engine into a crankcase to the engine.

2. Description of Related Art

There is heretofore an intake manifold of this type, an example of which is disclosed in Japanese unexamined patent publication No. 2002-322953. This intake device includes a partition wall in an air connector provided in an intake manifold, the partition wall being arranged in parallel to a direction of an air flow, thereby forming upper and lower passages in order to split an air flow into two flows, upper and lower. The partition wall is partially formed with a through hole which allows communication between the upper and lower passages. The air connector is provided with a gas intake pipe having one end open to the through hole and the other end extending to the outside of the air connector. Through this gas intake pipe, PCV gas or the like is delivered into the intake manifold. In this device, the PCV gas delivered through the gas intake pipe is split at the through hole into the upper and lower passages and then distributed from the air connector into each runner (branch pipe).

In the intake device disclosed in the '953 publication, the gas introduced through the gas intake pipe is split into two flows above and below the partition wall. However, the gas is subsequently allowed to flow freely in each passage and further the inlet ports of the plurality of branch pipes are located at different distances from the air connector. Thus, the gas could not be readily equally distributed into the branch pipes.

In order to meet a demand for weight reduction and size reduction of an engine system, a lightweight and compact intake manifold has been recently required. Conceivably, the intake manifold could be molded of resin to reduce weight. As for such resin-molded intake manifold, however, the above '953 publication suggests no concrete technique for integrally forming the gas path or passage for PCV gas or the like.

SUMMARY OF THE INVENTION

The present invention has been made in view of the above circumstances and has a first object to provide an intake manifold arranged to equally distribute gas such as a PCV gas to a plurality of cylinders of an engine.

A second object is to provide, in addition to the first object, an intake manifold that is easy to manufacture and lightweight.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided an intake manifold including a collecting pipe and a plurality of branch pipes extending from the collecting pipe, the intake manifold comprising: a single gas intake port; a gas outlet port opening into each branch pipe; and a gas passage extending to be divided into more than one branch passages from the gas intake port to each gas outlet port; wherein the gas passage is configured so that the branch passages are equal in pressure loss which will be generated between the gas intake port and each gas outlet port.

According to another aspect of the present invention, there is provided an intake manifold including a collecting pipe and four branch pipes branched from the collecting pipe, the collecting pipe and the branch pipes being molded of resin, the intake manifold comprising: a single gas intake port; a gas outlet port opening into each branch pipe; and a gas passage extending to be divided into four branch passages from the gas intake port to each gas outlet port; wherein the gas passage is configured so that the four branch passages are equal in pressure loss which will be generated between the gas intake port and each gas outlet port, and the gas passage extends to be branched in two stages from the gas intake port to each gas outlet port, forming a tournament-form branch configuration which is symmetrical about the gas intake port, the gas intake port, the gas outlet ports, and the gas passage are provided near outlet ports of the branch pipes and, under an operating condition of the intake manifold, are located on top of the branch pipes so that the gas intake port is placed above the gas outlet ports, and the gas intake port and the gas passage are provided in a projecting section of a flat plate shape formed integrally with the branch pipes and projecting upward.

Furthermore, according to another aspect of the present invention, there is provided an intake manifold including a collecting pipe and four branch pipes branched from the collecting pipe, the collecting pipe and the branch pipes being molded of resin, the intake manifold comprising: a single gas intake port; a gas outlet port opening into each branch pipe; and a gas passage extending to be divided into four branch passages from the gas intake port to each gas outlet port; wherein the gas passage is configured so that the four branch passages are equal in pressure loss which will be generated between the gas intake port and each gas outlet port, and the gas passage extends to be branched in two stages from the gas intake port to each gas outlet port, forming a tournament-form branch configuration which is symmetrical about the gas intake port, the gas intake port, the gas outlet ports, and the gas passage are provided near outlet ports of the branch pipes and, under an operating condition of the intake manifold, are located on top of the branch pipes so that the gas intake port is placed above the gas outlet ports, and the collecting pipe and the branch pipes are formed from at least two resinous molded bodies integrally joined to each other, the gas intake port and the gas passage are provided in the projecting section integrally molded with the two resinous molded bodies forming the branch pipes, and the projecting section is formed from flat-shaped projecting parts integrally molded in wedgewise form with the two resinous molded bodies respectively and joined to each other, and the two resinous molded bodies forming the branch pipes are joined to each other by welding, each of the projecting parts is formed, on its joining face, with a passage groove defining the gas passage, a pair of welding portions on both sides of the passage groove, and a flash cover outside each welding portion.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of an intake manifold embodying the present invention will now be given referring to the accompanying drawings.

Figure 1:
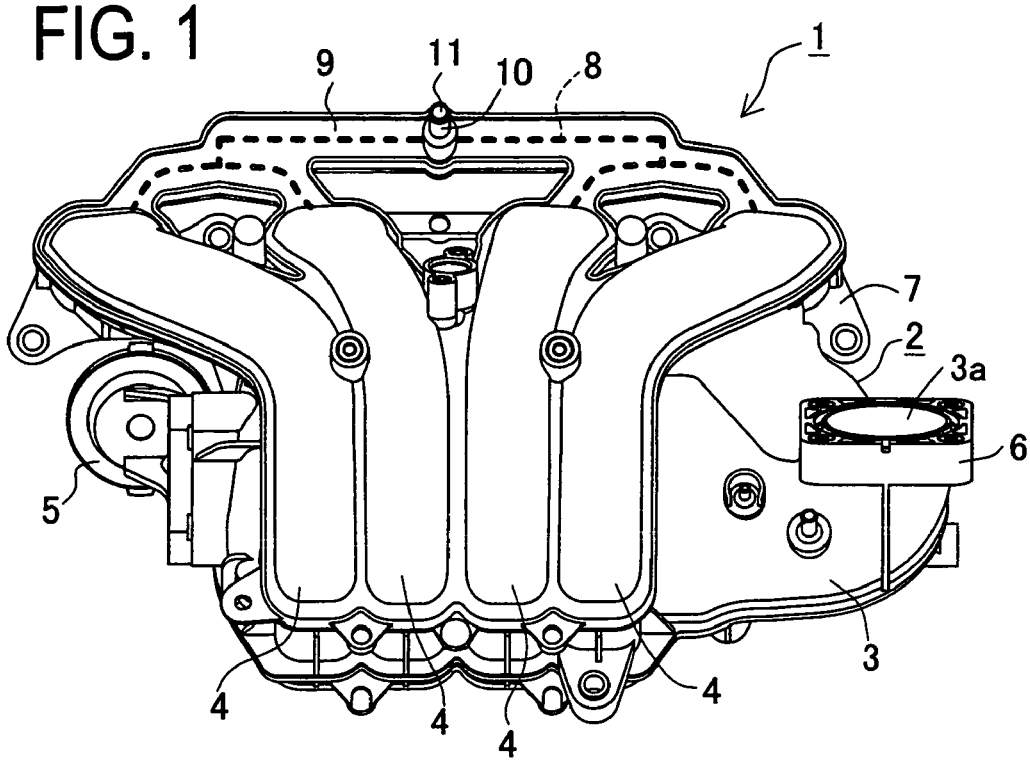
FIG. 1 is a front view of an intake manifold.
Figure 2:
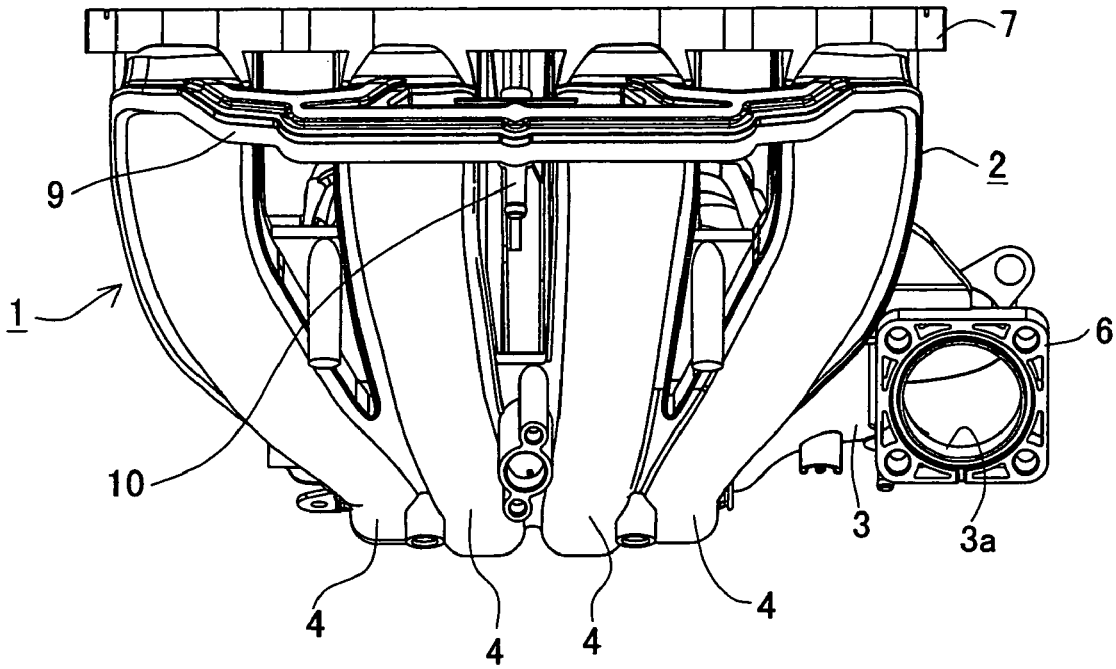
FIG. 2 is a plan view of the intake manifold.

FIG. 1 shows a front view of an intake manifold 1 in the present embodiment. FIG. 2 shows a plan view of the intake manifold 1 and FIG. 3 shows a left side view of same.

This intake manifold 1 is to be mounted in an engine to deliver air into a plurality of cylinders of the engine. The intake manifold 1 includes a manifold main body 2 (hereinafter, simply referred to as a "main body") made of resin. This main body 2 is provided with a collecting pipe 3 connected to an air cleaner and the like and a plurality of branch pipes 4 branched from the collecting pipe 3. In the present embodiment, the intake manifold 1 includes four branch pipes 4 so as to be used for a four-cylinder engine. The intake manifold 1 is internally provided with a variable intake valve (not shown). A diaphragm-type actuator 5 is mounted to the main body 2 in order to open and close the variable intake valve.

Figure 3:
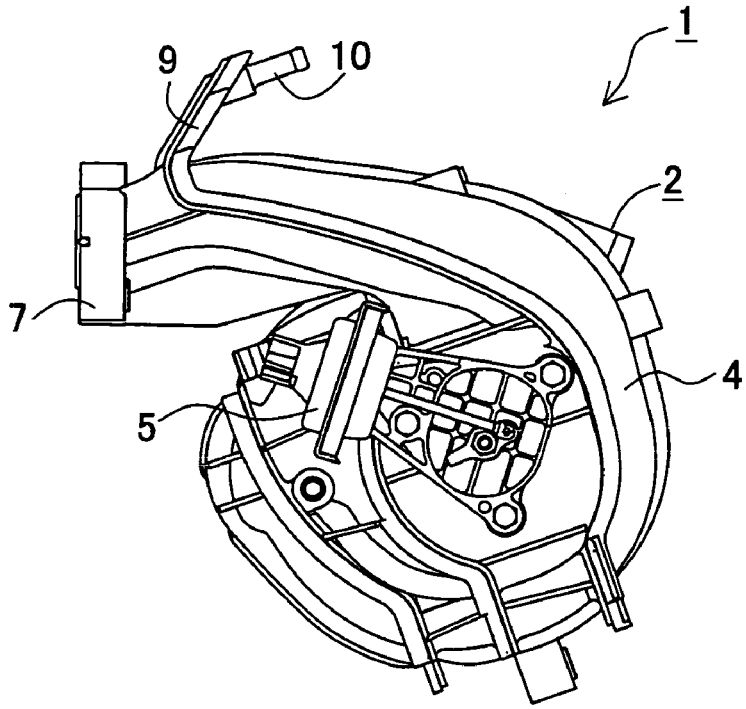
FIG. 3 is a left side view of the intake manifold.
Figure 4:
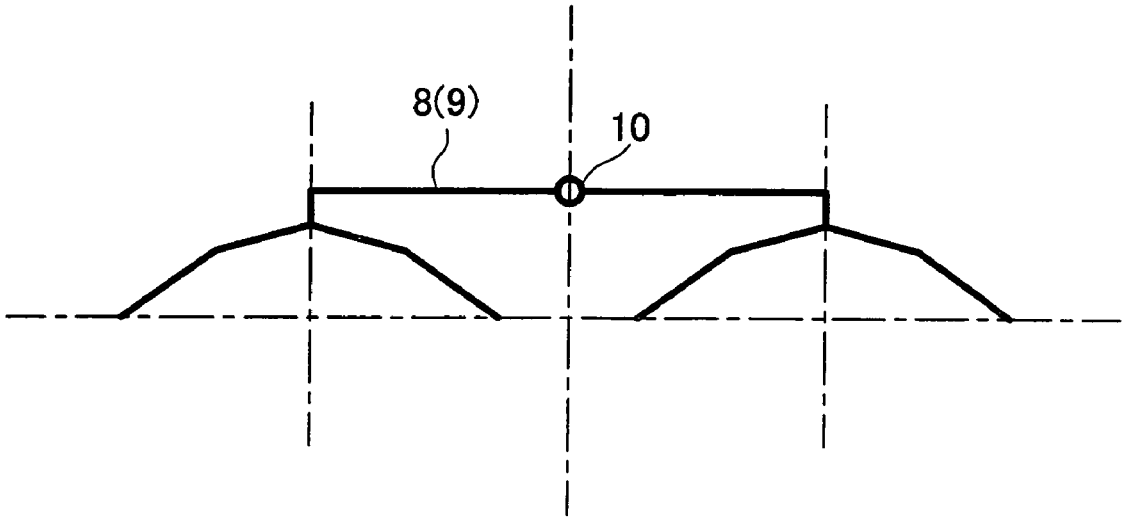
FIG. 4 is a conceptual view showing a tournament-form branch configuration.

As shown in FIGS. 1 to 3, a flange 6 is provided at an inlet port 3*a* of the collecting pipe 3. This flange 6 is connected to a throttle body and the like. On the back side of the intake manifold 1 is provided a flange 7 which is connected to the engine. Each outlet port 4*a* (see FIG. 8) of the branch pipes 4 is opened into the flange 7. Near the outlet ports 4*a* of the branch pipes 4, i.e., near the flange 7, there is provided a projecting section 9 internally including a gas passage 8 for returning a blowby gas (a PCV gas) leaking out of the engine into a crankcase, to the engine. This projecting section 9 is arranged to be located on top of the branch pipes 4, that is, at an upper side of the intake manifold 1 of the engine under an operating condition. The projecting section 9 is formed in a flat plate shape projecting obliquely upward, as shown in FIGS. 1 to 3, at the upper side of the intake manifold 1. This projecting section 9 is centrally provided with a single protruding pipe joint 10. In this pipe joint 10, a single gas intake port 11 is provided for introducing the PCV gas into the intake manifold 1. As shown in FIG. 1, the projecting section 9 with the gas passage 8 formed therein is arranged to be branched from the pipe joint 10 (the gas intake port 11) toward the branch pipes 4 in stages (in two stages) and in symmetrical relation with respect to the pipe joint 10 (the gas intake port 11), forming a so-called "tournament-form branch configuration". This tournament-form branch configuration is illustrated in FIG. 4, which is a conceptual view thereof.

Figure 5:
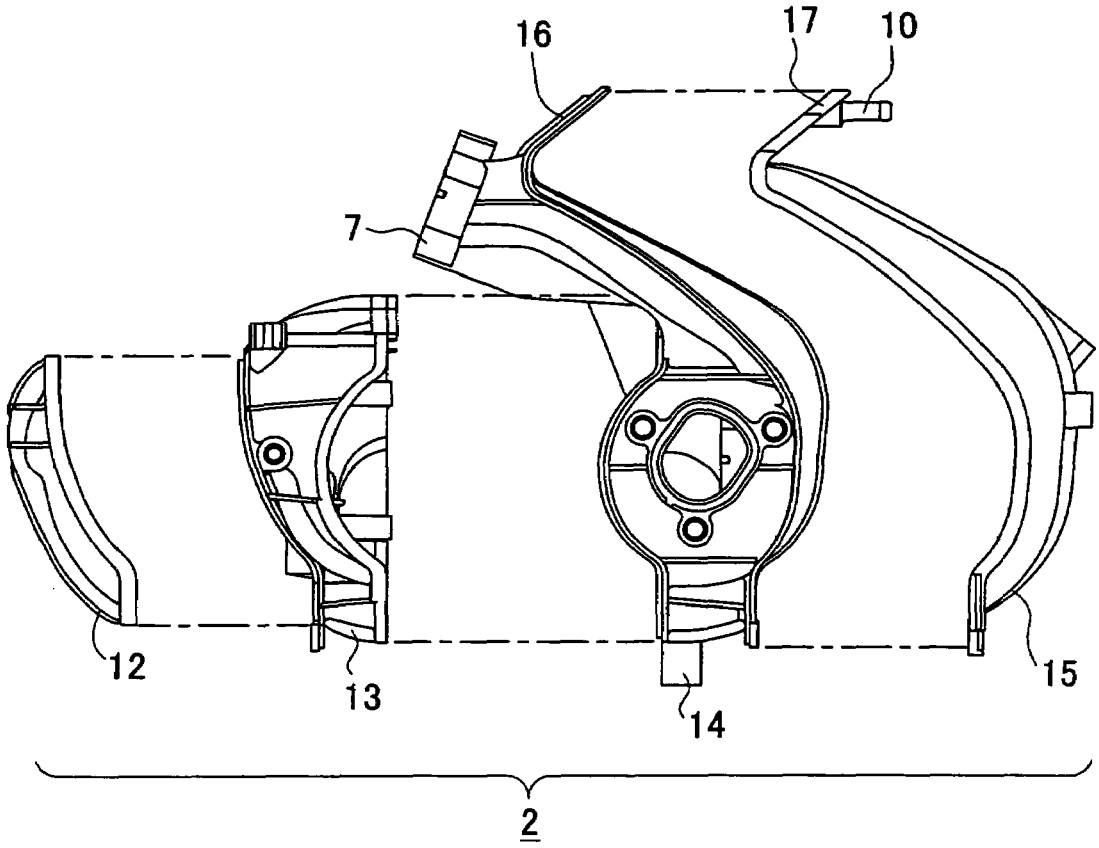
FIG. 5 is a left side view of a manifold main body in an exploded state.

In the present embodiment, the main body 2 except for attachments such as the actuator 5 and the variable intake valve is made by integrally assembling a plurality of resinous molded bodies that have been individually molded of resin. FIG. 5 shows a left side view of the main body 2 in an exploded state. The main body 2 in the present embodiment includes four resinous molded bodies, that is, a lower body 12, a middle body 13, a middle upper body 14, and an upper body 15, which are integrally joined to one another. In the present embodiment, these bodies 12 to 15 are joined by vibration-welding as mentioned later.

Figure 6:
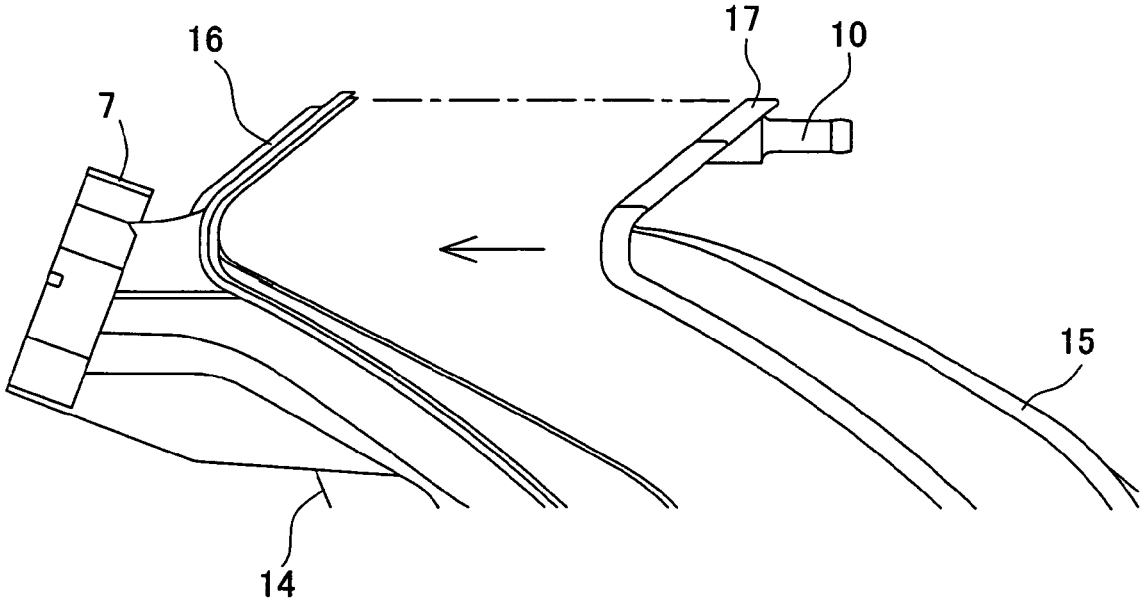
FIG. 6 is an enlarged left side view of projecting parts to be coupled with each other and their peripheral parts.
Figure 7:
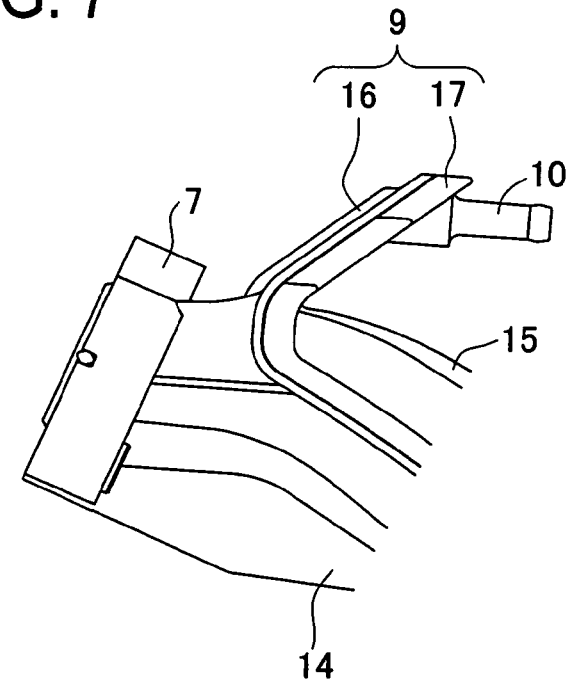
FIG. 7 is an enlarged left side view of a projecting section and its peripheral parts.

The projecting section 9 and the pipe joint 10 are formed by joining a pair of the projecting parts 16 and 17 integrally formed in two resinous molded bodies constructing each branch pipe 4, i.e., the middle upper body 14 and the upper body 15. FIG. 6 shows an enlarged view of the two projecting parts 16 and 17 facing to each other. FIG. 7 shows an enlarged view of the projecting section 9. The projecting parts 16 and 17, each having a flat plate shape, are provided wedgewise to the middle upper body 14 and the upper body 15 respectively as shown in FIG. 6. These projecting parts 16 and 17 are joined to each other when the middle upper body 14 and the upper body 15 are assembled into one piece, forming the projecting part 9 as shown in FIG. 7. This projecting part 9 is provided with the gas intake port 11, gas outlet ports 18 (see FIGS. 8, 10 to 12) each opening into each branch pipe 4, and the gas passage 8 extending from the gas intake port 11 is divided into more than one branches up to the gas outlet ports 18. The gas passage 8, having the tournament-form branch configuration, is designed so that the branch passages are equal in pressure loss which will be generated between the gas intake port 11 and each gas outlet port 18. In other words, the gas intake port 11 and the gas passage 8 are provided in the projecting section 9 integrally molded with the middle upper body 14 and the upper body 15 forming each branch pipe 4. This projecting section 9 is formed when the projecting parts 16 and 17 integrally formed in the middle upper body 14 and the upper body 15 are joined to each other.

Figure 8:
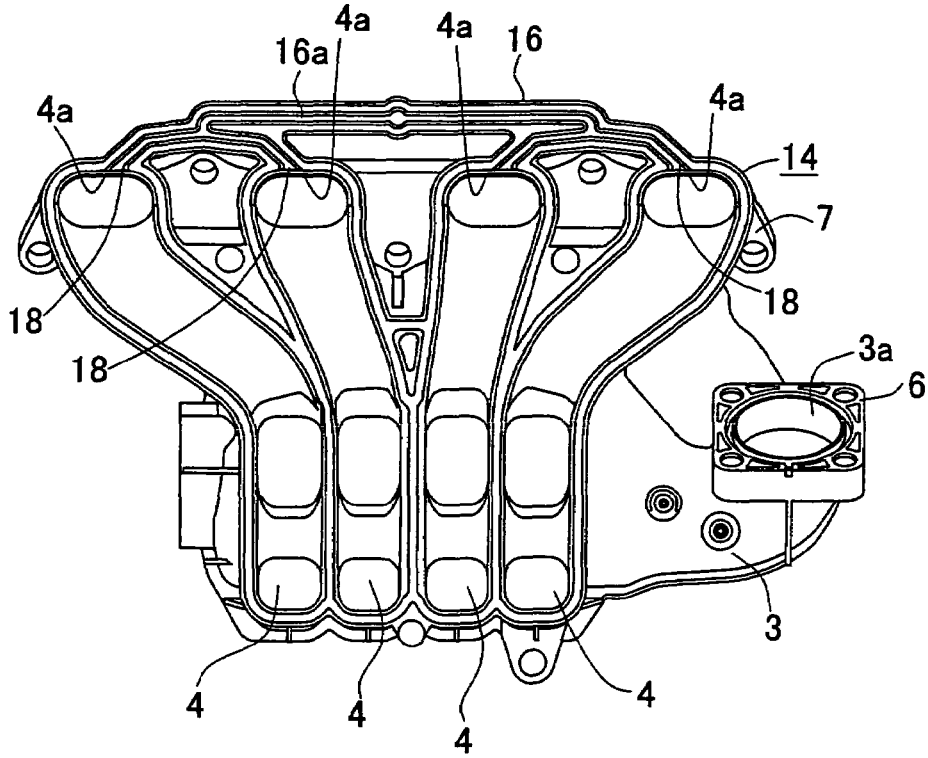
FIG. 8 is a front view of a middle upper body.
Figure 9:
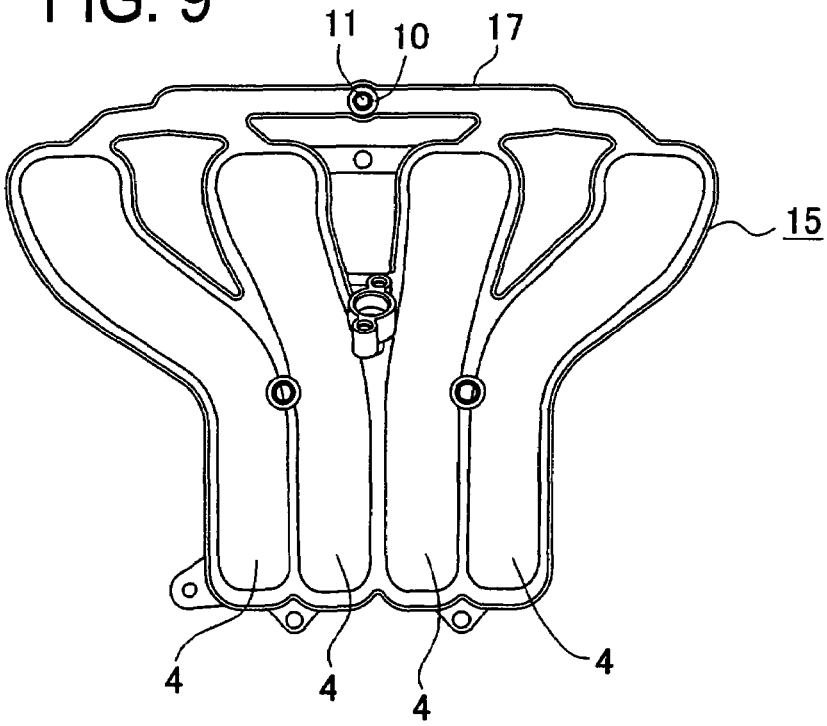
FIG. 9 is a front view of an upper body.
Figure 10:
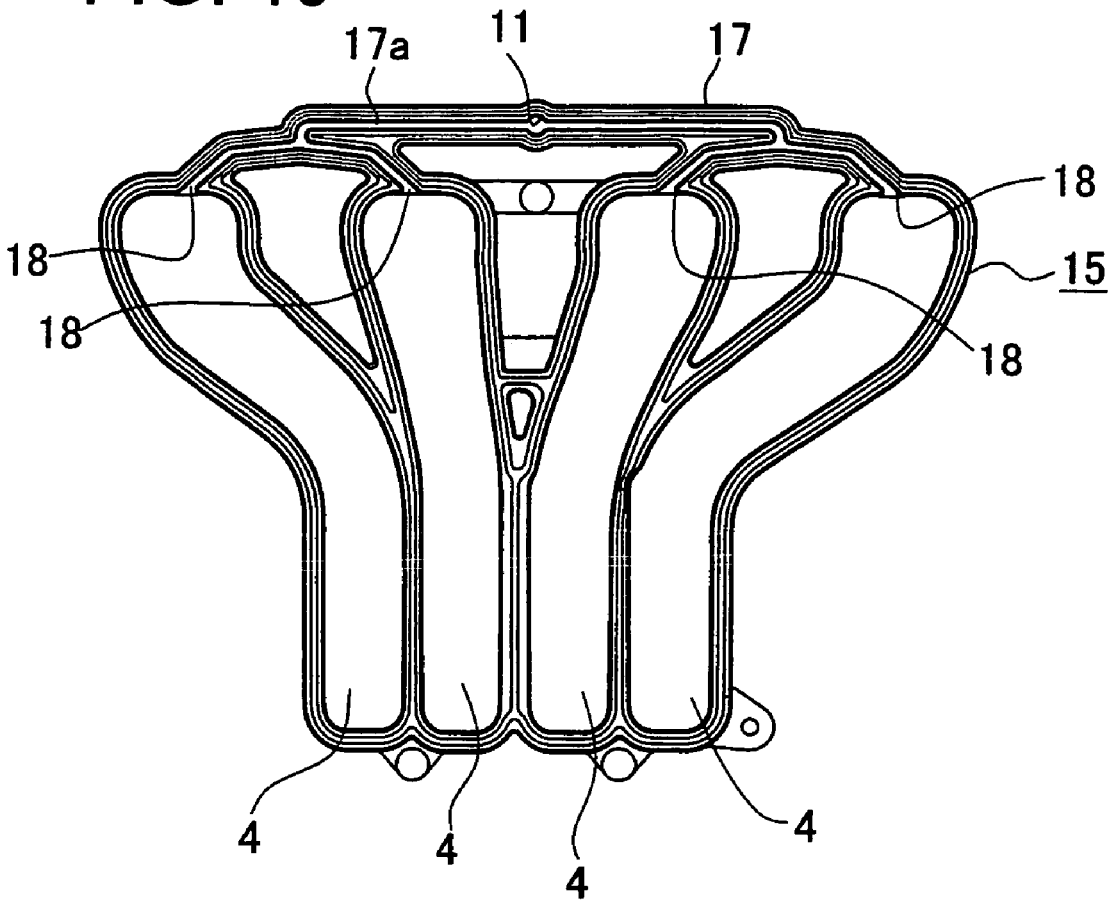
FIG. 10 is a back view of the upper body.
Figure 11:
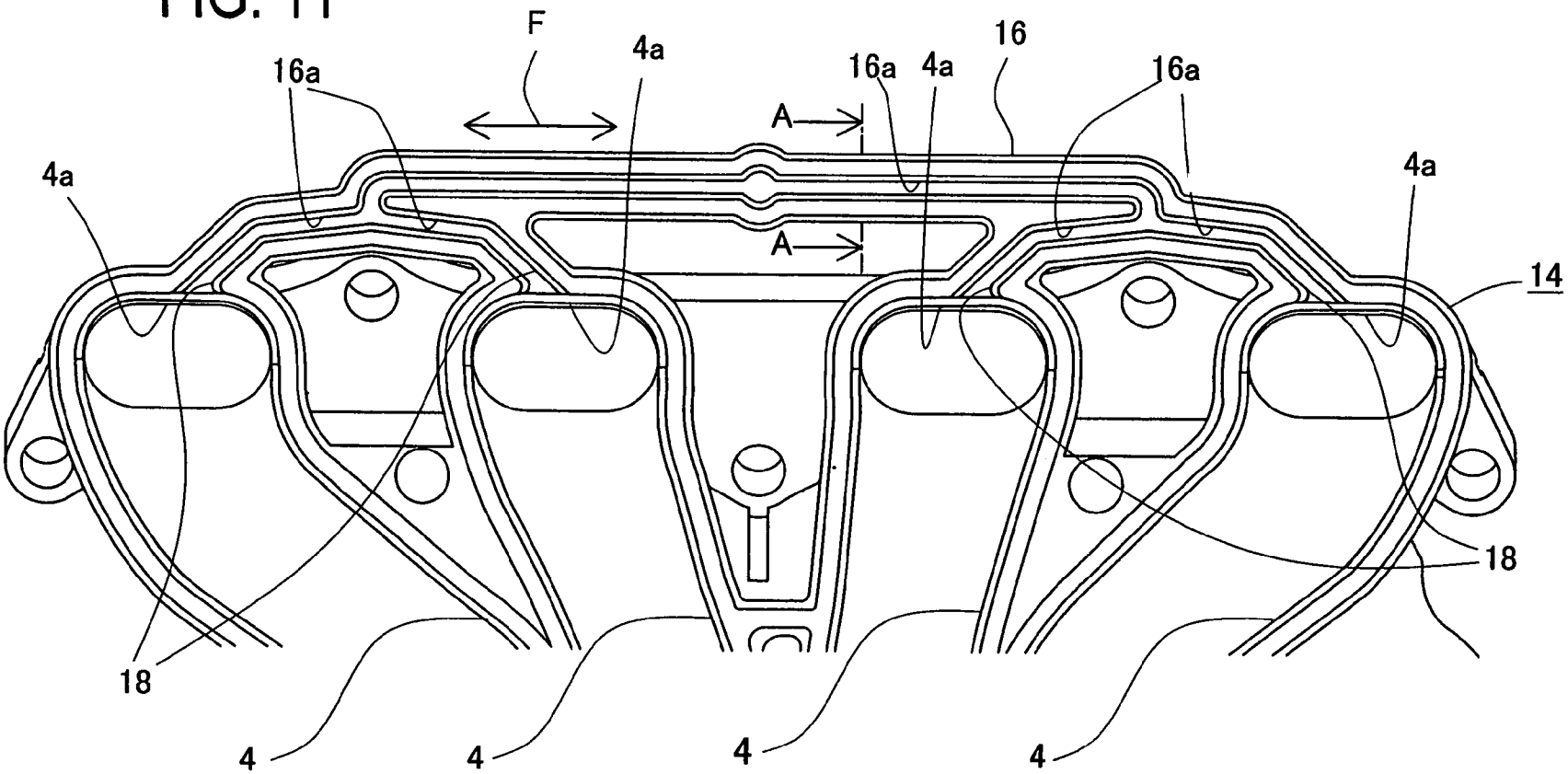
FIG. 11 is an enlarged view of a main part of the middle upper body of FIG. 8.
Figure 12:
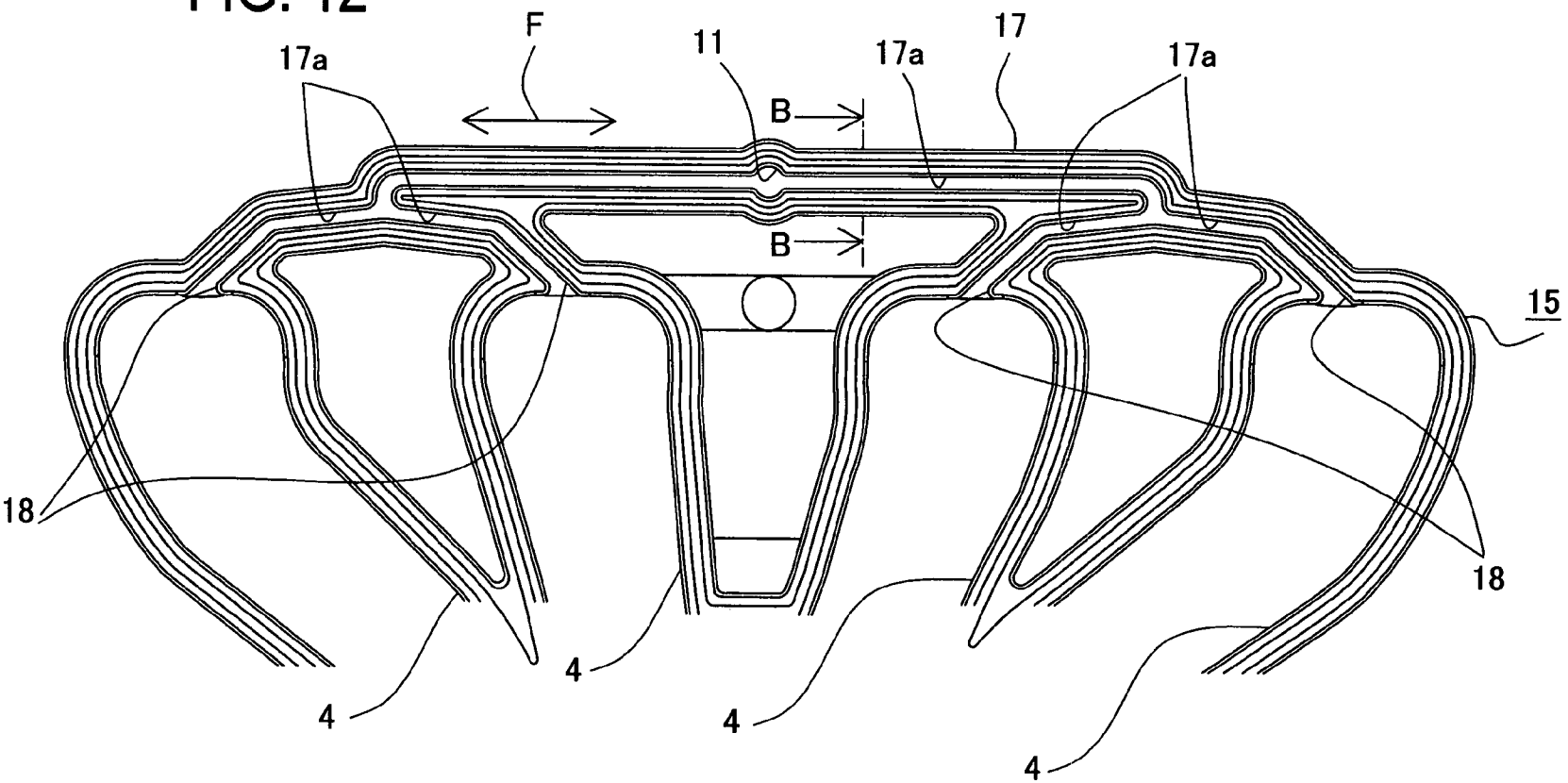
FIG. 12 is an enlarged view of a main part of the upper body of FIG. 10.

FIG. 8 shows a front view of the middle upper body 14. FIG. 9 shows a front view of the upper body 15. FIG. 10 shows a back view of the upper body 15. FIG. 11 shows an enlarged view of a part of the projecting part 16 of FIG. 8. FIG. 12 shows an enlarged view of a part of the projecting part 17 of FIG. 10. The projecting parts 16 and 17 are formed, on respective joining surfaces, with passage grooves 16*a* and 17*a* defining the gas passage 8 as shown in FIGS. 8 and 10 to 12. At the center of the passage groove 17*a* of the upper body 15, the gas intake port 11 is formed. Each end of the passage grooves 16*a* and 17*a* forms the gas outlet port 18 that is open into and communicated with each branch pipe 4. The passage grooves 16*a* and 17*a* of the projecting parts 16 and 17 have contours coincident with each other.

The configuration of the gas passage 8 is apparent from the contours of the passage grooves 16*a* and 17*a*. Specifically, the gas passage 8 shown in FIG. 1 is configured to extend to be branched in stages from the gas intake port 11 to each gas outlet port 18, thus providing the tournament-form branch configuration symmetrical with respect to the gas intake port 11. As is clearly from FIGS. 8 and 10 to 12, the gas intake port 11, the gas outlet ports 18 and the gas passage 8 are provided near the outlet port 4*a* of each branch pipe 4. They are arranged to be located on top of the branch pipes 4 in the intake manifold 1 of the engine under an operating condition so that the gas intake port 11 is placed above the gas outlet ports 18.

Figure 13:
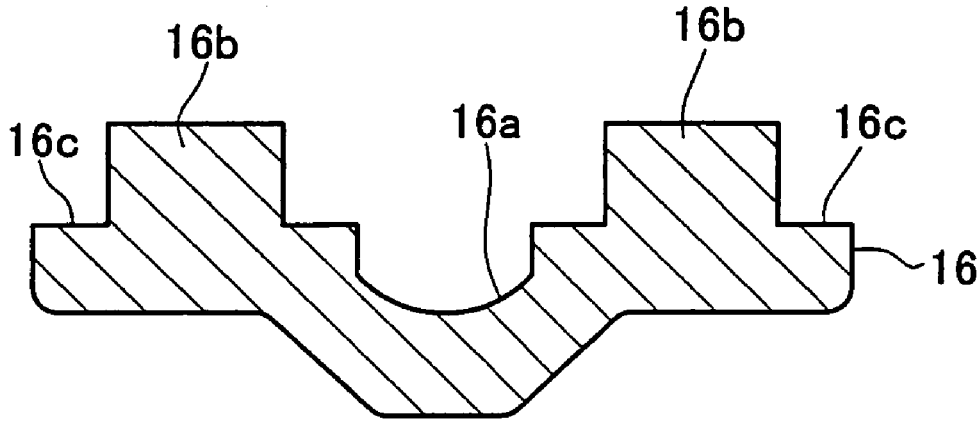
FIG. 13 is a sectional view of the middle upper body, taken in line A-A in FIG. 11.
Figure 14:
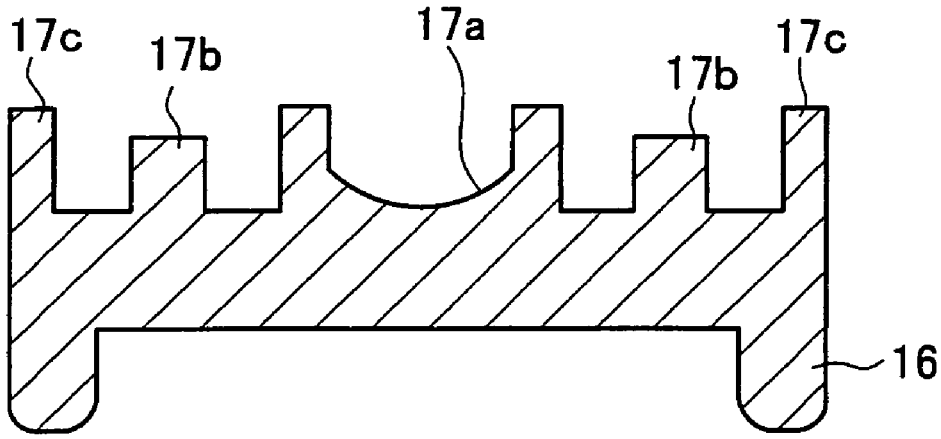
FIG. 14 is a sectional view of the upper body, taken in line B-B in FIG. 12.

FIG. 13 shows a sectional view of the middle upper body 14 taken in line A-A in FIG. 11. FIG. 14 is a sectional view of the upper body 15 taken in line B-B in FIG. 12. In the present embodiment, when the middle upper body 14 and the upper body 15 are joined to each other by vibration-welding, the projecting parts 16 and 17 are simultaneously joined to each other by the vibration-welding. On the joining surface of the projecting part 16 of the middle upper body 14, as shown in FIGS. 11 and 13, there are formed the passage groove 16*a* defining the gas passage 8, a pair of protruding portions 16*b* to be welded (hereinafter, "welding portions"), these welding portions 16*b* being arranged on either side of the passage groove 16*a*, and stepped flash covers 16*c* located outside the welding portions 16*b* respectively. Similarly, on the joining surface of the projecting part 17 of the upper body 15, there are formed the passage groove 17*a* defining the gas passage, a pair of protruding portions 17*a* to be welded (hereinafter, "welding portions"), these welding portions 17*a* being arranged on either side of the passage groove 17*a*, and protruding flash covers 17*c* located outside the welding portions 17*b* respectively.

Figure 15:
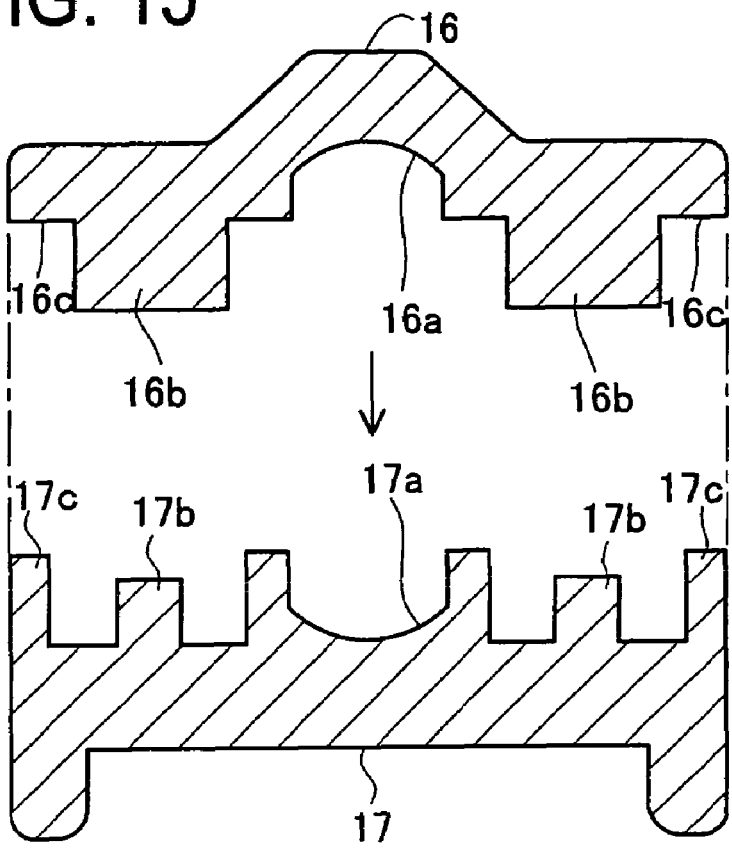
FIG. 15 is a sectional view of a relation between the two projecting parts.
Figure 16:
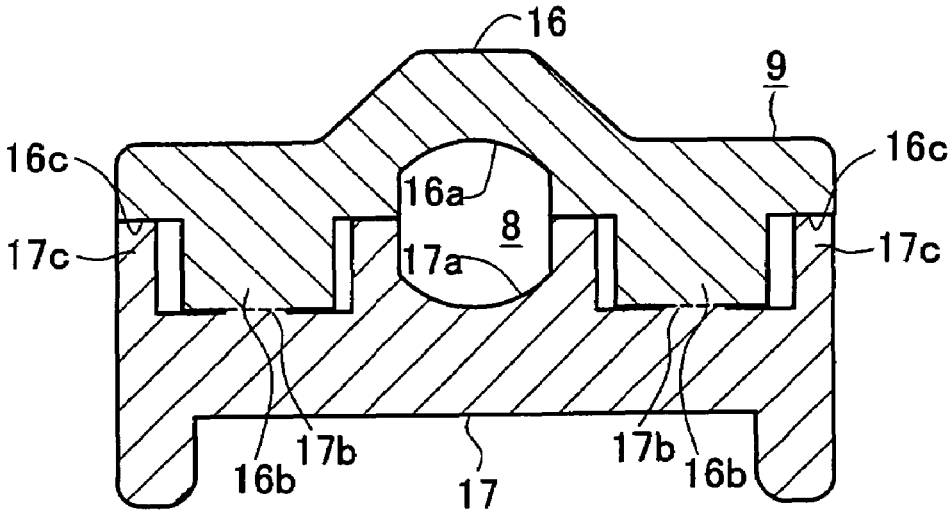
FIG. 16 is a sectional view of the projecting section.

FIG. 15 is a sectional view of the two projecting parts 16 and 17 facing to each other. FIG. 16 is a sectional view of the welded projecting parts 16 and 17, that is, the projecting section 9. In course of engaging the middle upper body 14 and the upper body 15, the projecting parts 16 and 17 are engaged in coincidence with each other. Under this engaged condition, the middle upper body 14 and the upper body 15 are vibration-welded to each other and simultaneously the projecting parts 16 and 17 are also vibration-welded. The welding portions 16*b* and 17*b* of the projecting parts 16 and 17 are melted and welded to each other. Thus, the projecting section 9 as shown in FIG. 16 can be formed. The gas passage 8 in such projecting section 9 is flat in section as shown in this FIG. 16.

Figure 17:
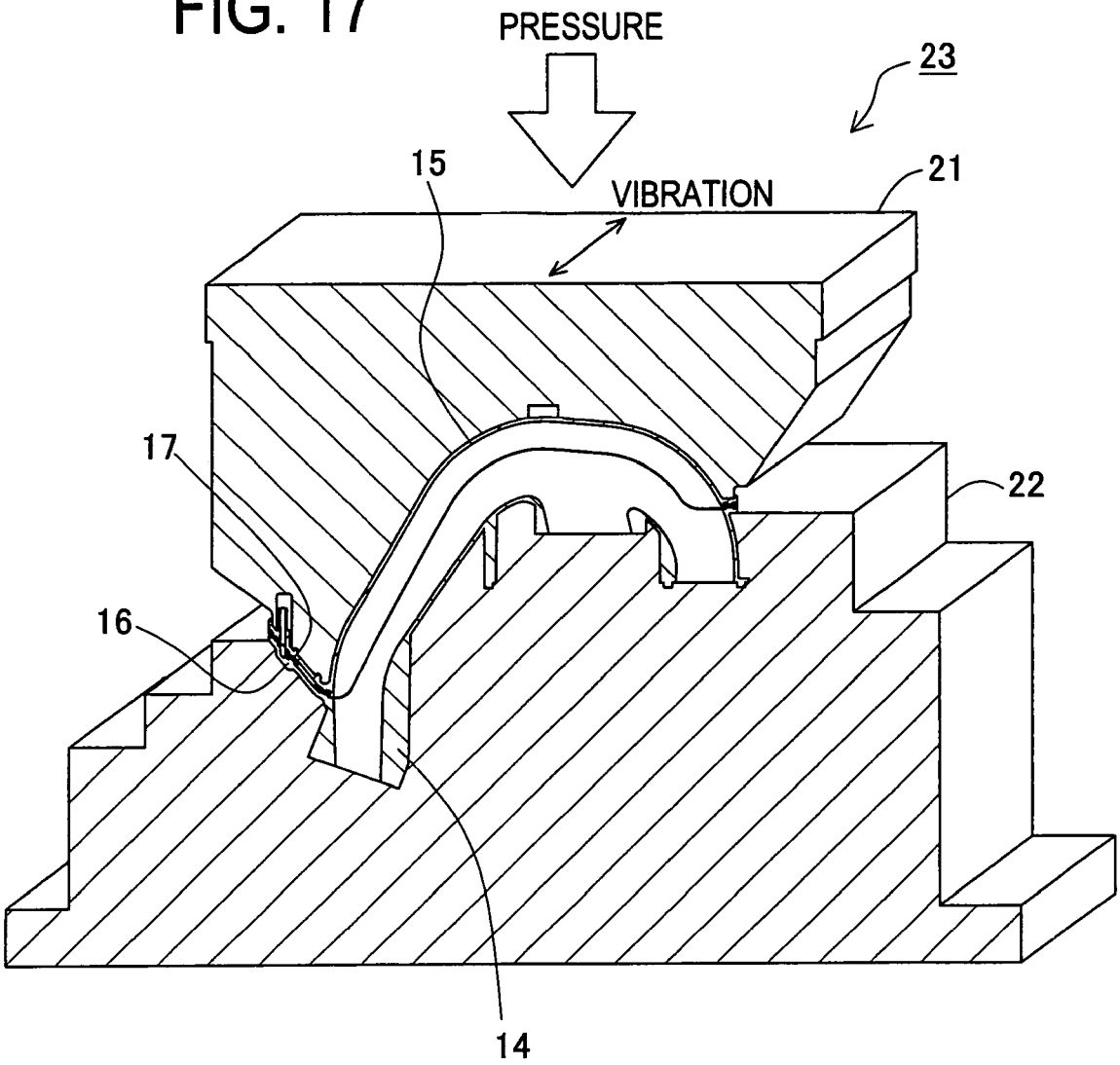
FIG. 17 is a conceptual view showing a vibration-welding technique.

FIG. 17 shows a conceptual view showing the vibration-welding technique. This vibration-welding technique uses a vibration-welding device 23 including a pair of upper and lower press dies 21 and 22. In this vibration-welding technique, the middle upper body 14 and the upper body 15 are first set in the engaged condition between the press dies 21 and 22. Under a predetermined pressure, a predetermined amplitude of vibration is applied to the projecting section 9 in a longitudinal direction thereof (in a direction represented by an arrow F in FIGS. 11 and 12). Herein, the predetermined pressure is for example a pressure of about "1675 kgf" and the predetermined amplitude of vibration is about "1.5 mm", which is applied to the projecting section 9 at an appropriately adjustable oscillation frequency.

According to the structure of the intake manifold 1 in the present embodiment described above, the gas passage 8 provided in the projecting section 9 is designed so that the branch passages are equal in pressure loss which will be generated between the gas intake port 11 and each gas outlet port 18. Thus, each portion of the gas passage 8 has equal flow resistance. This allows the pressure of PCV gas that is introduced into the gas intake port 11 to equally act on each portion of the gas passage 8. Accordingly, under the operating condition of the engine in which the intake manifold 1 is mounted, the PCV gas can be distributed equally into each cylinder through the gas passage 8.

In the present embodiment, furthermore, the gas passage 8 provided in the projecting section 9 extends to be branched in stages from the gas intake port 11 to each gas outlet port 18, forming the tournament-form configuration symmetrical with respect to the gas intake port 11. Accordingly, the PCV gas to be introduced through the gas intake port 11 is split equally in stages at each branched portion up to each gas outlet port 18. It is therefore possible to distribute PCV gas more equally into each cylinder of the engine as compared with the case where the gas passage is arranged to merely make equal pressure loss of each branch passage which will be generated between the gas intake port and each gas outlet port.

In a typical intake manifold, an outlet port of each branch pipe is directly connected to an intake port of an engine main body. The intake port will be subjected to a negative pressure substantially equal to that generated in each cylinder of the engine main body. With the structure of the intake manifold 1 in the present embodiment, the gas intake port 11 provided in the projecting section 9, the gas outlet ports 18, and the gas passage 8 are arranged near the outlet ports 4*a* of each branch pipe 4. Thus, each gas outlet port 18 is located near the intake port of the engine main body. Even if the branch pipes 4 are slightly different in length, the negative pressure substantially equal to that generated in each cylinder of the engine will directly be exerted on each gas outlet port 18. It is therefore possible to distribute the PCV gas more equally to each cylinder of the engine regardless of different lengths of the branch pipes 4.

In the present embodiment, furthermore, under the operating condition of the intake manifold 1 of the engine, the gas intake port 11 provided in the projecting section 9, the gas outlet ports 18, and the gas passage 8 are located on top of the branch pipes 4 so that the gas intake port 11 is located above the gas outlet ports 18. Accordingly, the gas passage 8 serves as a passage extending downward from the gas intake port 11 to each gas outlet port 18. The water or moisture that comes into the gas passage 8 is thus allowed to flow downward. This makes it possible to prevent such water or moisture from staying in the gas passage 8. Consequently, the gas passage 8 can be always maintained to provide a smooth flow of the PCV gas.

In the present embodiment, the main body 2, i.e., the collecting pipe 3 and the branch pipes 4 are molded of resin, achieving a reduction in weight of the intake manifold 1. Since the gas intake port 11 and the gas passage 8 are provided in the projecting section 9 integrally molded with the branch pipes 4, the gas passage 8 can be readily formed as compared with the case of forming a gas passage in each branch pipe. In this regard, the intake manifold 1 provided with the gas passage 8 for PCV gas distribution can be relatively readily made of resin by molding, thus achieving a reduction in weight.

In the present embodiment, the main body 2, i.e., the collecting pipe 3 and the branch pipes 4 are formed by integral joining of a plurality of resinous molded bodies; the lower body 12, the middle lower body 13, the middle upper body 14, and the upper body 15. Accordingly, molding of each body 12 to 14 can be made relatively easily. This makes it possible to facilitate manufacture of the main body 2 originally having a complicated shape and hence facilitate manufacture of the intake manifold 1. Furthermore, the gas intake port 11 and the gas passage 8 are provided in the projecting section 9 integrally molded with two resin bodies forming the branch pipes 4, that is, the middle upper body 14 and the upper body 15. As compared with the case of forming the gas passage in each branch pipe, therefore, the gas passage 8 can be formed easily. The projecting section 9 is made when the projecting parts 16 and 17 integrally formed with the middle upper body 14 and the upper body 15 respectively are joined to each other. In other words, the projecting section 9 is made concurrently with formation of the branch pipes 4. Also in this regard, the intake manifold 1 can be manufactured in an easier manner than the intake manifold simply including the gas passage for the PCV gas and further a reduction in weight of the intake manifold 1 can be achieved.

According to the present embodiment, when the middle upper body 14 and the upper body 15 are welded to each other to form the branch pipes 4, the welding portions 16*b* and 17*b* of the projecting parts 16 and 17 are also welded to each other, thus simultaneously forming the projecting section 9. The intake manifold 1 can more readily be manufactured as compared with the case where the projecting section is welded independently of the bodies. In welding, the flash covers 16*c* and 17*c* cover the welded portions from outside of the welding portions 16*b* and 17*b*, so that the welded portions are made invisible. Thus, the product appearance of the intake manifold 1 can be improved.

In the present embodiment, each of the projecting parts 16 and 17 forming the projecting section 9 is of a flat shape. Even where the projecting parts 16 and 17 have a slight deformation or warp, therefore, such flat-shaped parts 16 and 17 can absorb respective deformation or warp when they are joined to each other. Thus, the projecting parts 16 and 17 can appropriately be welded to each other. The projecting section 9 formed by the projecting parts 16 and 17 is of an inclined, flat-shaped form as shown in FIGS. 3 and 7 in order to reduce the projecting angle of the projecting section 9 from the main body 2. Accordingly, the intake manifold 1 can be made in a relatively, entirely compact form even if provided with the projecting section 9.

In the present embodiment, the projecting section 9 providing the gas passage is integrally molded with the main body 2. Accordingly, the number of parts or components can be reduced, resulting in a reduction in manufacturing cost, as compared with the case where a pipe is additionally provided for the gas passage.

The present invention may be embodied in other specific forms without departing from the spirit or essential characteristics thereof.

In the embodiment, the intake manifold including the gas passage is exemplified as the intake manifold 1 which will be mounted in a four-cylinder engine, but it may be mounted in any engine regardless of the number of cylinders.

The gas passage 8 in the present embodiment is configured in the tournament-form branch configuration but not limited thereto. The gas passage may be arranged in any configuration, if only it is designed to make pressure loss of each branch passage equal at respective corresponding portions between the gas intake port and each gas outlet port.

In the present embodiment, two separate projecting parts 16 and 17 are joined to each other concurrently with the joining of the middle upper body 14 and the upper body 15, thereby forming the projecting section 9 including the gas passage 8. Alternatively, the projecting section may be formed of a single part, not two separate parts.

In the present embodiment, the gas passage 8 is provided for distributing the PCV gas to each cylinder of the engine. This gas passage 8 also may be used for distributing any gas but PCV gas to each cylinder. For example, it may be used for distributing a purge gas from a canister.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An intake manifold including a collecting pipe and four branch pipes branched from the collecting pipe, the collecting pipe and the branch pipes being molded of resin, the intake manifold comprising:

a single gas intake port;

a gas outlet port opening into each branch pipe; and a gas passage extending to be divided into four branch passages from the gas intake port to each gas outlet port;

wherein the gas passage is configured so that the four branch passages are equal in pressure loss which will be generated between the gas intake port and each gas outlet port, and the gas passage extends to be branched in two stages from the gas intake port to each gas outlet port, forming a tournament-form branch configuration which is symmetrical about the gas intake port, the gas intake port, the gas outlet ports, and the gas passage are provided near outlet ports of the branch pipes and, under an operating condition of the intake manifold, are located on top of the branch pipes so that the gas intake port is placed above the gas outlet ports, and the gas intake port and the gas passage are provided in a projecting section of a flat plate shape formed integrally with the branch pipes and projecting upward.

2. An intake manifold including a collecting pipe and four branch pipes branched from the collecting pipe, the collecting pipe and the branch pipes being molded of resin, the intake manifold comprising:

a single gas intake port;

a gas outlet port opening into each branch pipe; and a gas passage extending to be divided into four branch passages from the gas intake port to each gas outlet port;

wherein the gas passage is configured so that the four branch passages are equal in pressure loss which will be generated between the gas intake port and each gas outlet port, and the gas passage extends to be branched in two stages from the gas intake port to each gas outlet port, forming a tournament-form branch configuration which is symmetrical about the gas intake port, the gas intake port, the gas outlet ports, and the gas passage are provided near outlet ports of the branch pipes and, under an operating condition of the intake manifold, are located on top of the branch pipes so that the gas intake port is placed above the gas outlet ports, and the collecting pipe and the branch pipes are formed from at least two resinous molded bodies integrally joined to each other, the gas intake port and the gas passage are provided in the projecting section integrally molded with the two resinous molded bodies forming the branch pipes, and the projecting section is formed from flat-shaped projecting parts integrally molded in wedgewise form with the two resinous molded bodies respectively and joined to each other, and the two resinous molded bodies forming the branch pipes are joined to each other by welding, each of the projecting parts is formed, on its joining face, with a passage groove defining the gas passage, a pair of welding portions on both sides of the passage groove, and a flash cover outside each welding portion.

3. An intake manifold including a collecting pipe and a plurality of branch pipes extending from the collecting pipe, the intake manifold comprising:

a first-stage gas passage including a first gas intake port and a plurality of first gas outlet ports; and a plurality of second-stage gas passages each of which includes a second gas intake port corresponding to one of the first gas outlet ports and a pair of second gas outlet ports, wherein the first-stage gas passage and the plurality of second-stage gas passages are arranged in a tournament-form branch configuration which is symmetrical about the first gas intake port.

4. The intake manifold according to claim 3, wherein the gas intake ports, the gas outlet ports, and the gas passages are provided near outlet ports of the branch pipes and, under an operating condition of the intake manifold, are located on top of the branch pipes so that the first gas intake port is placed above the second gas outlet ports.

5. The intake manifold according to claim 4, wherein the collecting pipe and the branch pipes are molded of resin, and the gas intake ports and the gas passages are provided in a projecting section formed integrally with the branch pipes.

6. The intake manifold according to claim 4, wherein the collecting pipe and the branch pipes are formed from at least two resinous molded bodies integrally joined to each other, the gas intake ports and the gas passages are provided in a projecting section integrally molded with the two resinous molded bodies forming the branch pipes, and the projecting section is formed from projecting parts integrally molded with the two resinous molded bodies respectively and joined to each other.

7. The intake manifold according to claim 6, wherein the two resinous molded bodies forming the branch pipes are joined to each other by welding, each of the projecting parts is formed, on its joining face, with a passage groove defining the gas passages, a pair of welding portions on both sides of the passage groove, and a flash cover outside each welding portion.

8. The intake manifold according to claim 3, wherein the collecting pipe and the branch pipes are molded of resin, and the gas intake ports and the gas passages are provided in a projecting section formed integrally with the branch pipes.

9. The intake manifold according to claim 3, wherein the collecting pipe and the branch pipes are formed from at least two resinous molded bodies integrally joined to each other, the gas intake ports and the gas passages are provided in a projecting section integrally molded with the two resinous molded bodies forming the branch pipes, and the projecting section is formed from projecting parts integrally molded with the two resinous molded bodies respectively and joined to each other.

10. The intake manifold according to claim 9, wherein the two resinous molded bodies forming the branch pipes are joined to each other by welding, each of the projecting parts is formed, on its joining face, with a passage groove defining the gas passages, a pair of welding portions on both sides of the passage groove, and a flash cover outside each welding portion.

* * * * *